United States Patent [19]

Falco et al.

[11] Patent Number: 4,600,181

[45] Date of Patent: Jul. 15, 1986

[54] GAS COOLING AND RECIRCULATING DEVICE IN CONTINUOUS STRIP FURNACES

[75] Inventors: Giulio Falco; Ivo Mannucci, both of Genoa, Italy

[73] Assignee: Italimpianti Societa Italiana Impianti p.a., Genoa, Italy

[21] Appl. No.: 647,161

[22] Filed: Sep. 4, 1984

[30] Foreign Application Priority Data

Sep. 8, 1983 [IT] Italy ..... 12617 A/83

[51] Int. Cl.[4] ..... C21D 9/573

[52] U.S. Cl. ..... 266/102; 266/111; 266/259; 34/155

[58] Field of Search ..... 266/111-113, 266/102, 259; 148/156; 34/155, 219

[56] References Cited

U.S. PATENT DOCUMENTS 4,398,700 8/1983 Thome ..... 266/111

*Primary Examiner*—Christopher W. Brody

*Attorney, Agent, or Firm*—Berman, Aisenberg & Platt

[57] ABSTRACT

A "jet cooler" device for cooling and recirculating the gas forming the protective atmosphere in the cooling chambers of the furnaces for the continuous annealing of steel strips, comprises vertically arranged boxes (4) which extend in the furnace interior between successive vertically extending parallel strip sections, substantially over the whole length thereof, i.e., throughout the height of the furnace, and which have their walls (104) turned toward the facing adjacent strip sections provided with perforations (5). Associated to each vertically arranged perforated box (4) are a plurality of individual protective gas-cooling and recirculating units (6), which are distributed over the vertical extent of the respective box (4) and are attached to the outside of the furnace sidewalls (1). Each cooling and recirculating unit (6) comprises a heat exchanger (13) in form of a group of water-cooling rectilinear tubes, and a fan (11) that draws the protective gas from the furnace inside and cools it by causing the same to flow through the heat exchanger (13) and that blows this gas at a certain pressure into the associated vertically arranged box (4). The protective gas then flows out of the perforations (5) in the vertically arranged box (4) in form of jets directed to the facing surfaces of the adjacent strip sections.

6 Claims, 3 Drawing Figures

GAS COOLING AND RECIRCULATING DEVICE IN CONTINUOUS STRIP FURNACES

BACKGROUND AND SUMMARY OF THE INVENTION

The object of the invention is a device for cooling and recirculating the gas forming the protective atmosphere in the cooling chambers of furnaces for the continuous processing of metal strips, particularly for the continuous annealing of steel strips.

A device of this kind, so-called "jet cooler", comprises vertically arranged boxes which extend in the furnace interior between the successive vertically extending parallel strip sections, substantially over the whole length thereof, i.e. throughout the height of the furnace, and which have their walls turned toward the adjacent strip sections provided with perforations, to the said boxes there being associated a protective gas-cooling and recirculating unit comprising a heat exchanger, and a fan that draws the protective gas from the furnace interior and cools it by causing the same to flow through the heat exchanger, and that blows this gas at a certain pressure into the boxes, so that the cooled protective gas flows out of the perforations in the boxes in form of jets directed to the facing surfaces of the adjacent strip sections, whereby it causes the cooling of the strip.

In a known device of the above-disclosed kind, a plurality of suction ports communicating with the furnace interior, and a plurality of delivery ports communicating with the interior of the perforated boxes, are provided in the furnace sidewall. To all the perforated boxes, or at least to a number of same, there is associated only one cooling and recirculating system with only one fan that through suitable tubes draws the protective gas from the suction ports and causes the same to flow through only one heat exchanger, so that it blows the cooled gas through suitable delivery tubes into the vertically arranged perforated boxes. The drawback of this known device resides in the fact that big volumes of protective gas will be displaced from the furnace interior through suction and delivery tubes into an external cooling and recirculating system, which increases the risk of this gas becoming polluted owing to any possible leaks in the tubes, or to any defect in their tightness. Moreover, the said known device has great overall dimensions at the furnace outside, and occupies a rather large floor space.

In another known device for cooling and recirculating the protective gas in the cooling chambers of furnaces for the continuous annealing of steel strips, instead of the perforated boxes extending vertically over the whole height of the furnace, a plurality of individual horizontally arranged boxes are provided between the parallel steel strip sections, and these boxes extend into the furnace transversely to the longitudinal direction of the said steel strip sections, and are distributed at predetermined intervals over the furnace height. Each one of these individual horizontally arranged boxes is tightly welded to the furnace sidewall and partly projects out of the furnace. Associated to each horizontally arranged individual box are a heat exchanger and a fan, preferably a centrifugal fan, which are housed in the box portion projecting out of the furnace. The opposite sidewalls of each horizontally arranged individual box, which are turned toward the two adjacent strip sections, are perforated. Moreover, each horizontally arranged box has a suction chamber containing the heat exchanger and communicating with the interior of the furnace through suction ports provided in the upper and/or the lower end of the horizontally arranged individual box. The fan of each horizontally arranged individual box draws the protective gas through the said suction ports and through the said suction chamber in the box, thus causing the said gas to flow through the heat exchanger, where the gas is cooled. The cooled protective gas is blown by the fan into the respective horizontally arranged individual box, and is caused to flow out through the perforations in said box, in form of cooling jets directed to the two adjacent strip sections.

This known device with a plurality of horizontally arranged individual boxes provided in a superposed aligned relation between every two successive vertically extending strip sections, has the drawback that the entire perforated useful area through which the cooled protective gas jets are directed to the strip, is only a fraction of the area directly facing the strip, owing to the vertical spacing apart of the superposed horizontally arranged individual boxes from one another. This remarkably decreases the useful cooling area and—with the available spaces being equal, proportionally decreases the installable cooling power. Therefore, this known device does not satisfactorily meet the requirements of the continuously operated modern furnaces, in which a specific high cooling power needs to be installed.

Another drawback of the said known device with horizontally arranged individual boxes resides in the fact that when one or more of the individual protective gas-cooling and recirculating units, respectively associated to the horizontally arranged individual boxes forming part of the same vertically extending file of these boxes, should stop owing to a failure, a local unbalance in the pressures acting on the strip might be produced whenever all the cooling and recirculating units in the next-adjacent vertically extending file of individual horizontally arranged boxes continue to be regularly operated, so that they tend to push the strip toward the individual horizontally arranged boxes comprising the cooling and recirculating units affected by a failure, and the strip is then caused to rub against the structure of these individual boxes. By such a rubbing, the surface of the strip may be damaged, and the final quality of the strip may be inevitably deteriorated. In order to reset a pressure balance and avoid the said rubbing of the strip, in the instance of a breakdown and a stopping of a certain number of cooling and recirculating units, respectively associated to the individual vertically arranged boxes in the same vertically extending file, the cooling and recirculating units of the facing horizontally extending boxes in the opposite file might be intentionally excluded, but this would determine a further important reduction in the overall cooling capacity.

A further drawback of the known device with individual horizontally arranged boxes arises from the fact that the heat exchanger of each protective gas-cooling and recirculating unit consists of a water-cooled finned tube group extending into, and out of the respective individual box with a recumbent U-shaped or horse shoe-shaped path. In this embodiment, the protective gas to be cooled tends to flow only through the arcuate inner part of the cooling tube group, while the rectilinear parts of said U-shaped cooling tube group are scarcely utilized, since they are situated in a fluiddynamically calm zone of the suction chamber in the respective horizontally artranged individual box. Consequently, the actual efficiency of the heat exchanger is considerably reduced, whereby it produces, with the same overall dimensions, a further reduction in the specific cooling capacity.

The object of the invention is to eliminate the drawbacks of both of the above-disclosed kinds of known devices, and for this purpose the invention provides a cooling and recirculating device of the kind as disclosed at the beginning, substantially characterized in that a plurality of individual cooling and recirculating units are associated to each perforated vertically arranged box extending throughout the furnace height, and are distributed over the vertical extent of the respective box, and are attached to the outside of the furnace sidewalls.

In one preferred embodiment of the invention, each individual cooling and recirculating unit associated to one perforated vertically arranged box consists of a sealed case element, tightly attached to the outside of the furnace sidewall, and which is comparted into a suction chamber containing a heat exchanger and communicating with the interior of the furnace through the side of the respective perforated vertically arranged box, and into a delivery chamber containing a fan and communicating with the interior of the said perforated vertically arranged box, the suction inlet of the fan being connected to the said suction chamber, and the delivery outlet of the fan being in communication with the said delivery chamber.

By the cooling and recirculating device of the invention the advantages are maintained of the perforated vertically arranged boxes extending throughout the furnace height, but the drawbacks are eliminated of the known constructions using these vertically arranged boxes, since in place of only one cooling and recirculating system associated to all or to a number of the perforated vertically arranged boxes, a plurality of cooling and recirculating units are provided, which are associated to each perforated vertically arranged box and are distributed over the height of the same, and which contain each their own cooling and recirculating unit with a heat exchanger and a fan, and are applied to the outside of the furnace sidewall. Thus the piping of the protective gas over a long conveyance path outside of the furnace is avoided, and the risk of the said gas becoming polluted is then eliminated. Moreover, the device of the invention also has reduced overall dimensions as compared with the above-disclosed known construction having only one cooling and recirculating system, and these overall dimensions are however limited to the furnace sidewalls, and do not occupy any floor space. Consequently, the device of the invention also has a higher specific cooling capacity in relation to the occupied volumes.

With regard to the known constructions comprising perforated individual boxes horizontally arranged in a superposed aligned relation, the cooling and recirculating device of the invention affords the advantage of avoiding any local pressure unbalance in the case of a breakdown and a stopping of one or more of the individual cooling and recirculating units associated to the same vertically arranged perforated box. In fact, in such a case, the pressure decrease within the perforated vertically arranged box connected to the broken down cooling and recirculating unit or units is not limited to a localized relatively short section, but will spread through the respective vertically arranged perforated box, i.e. throughout the height of the furnace, so that a relatively small decrease of the total pressure in the said vertically arranged box will be produced. This decrease of the total pressure within the vertically arranged perforated box connected to the cooling and recirculating unit or units affected by a breakdown, is unlikely to become so great as to cause the strip to be rubbed against the structure of said box under the action of the protective gas jets being directed against the opposite face of the strip, and flowing out of the opposite respective vertically arranged perforated box having all its associated cooling and recirculating units working properly.

Besides this automatic balancing of the pressure in the interior of the perforated boxes, the device of the invention compared to the known construction with perforated horizontally arranged individual boxes, naturally affords all the advantages typical of the perforated vertically arranged boxes, particularly a higher cooling efficiency, since for the cooling protective gas jets directed against the strip it is taken advantage of all the furnace height, and not of only one portion thereof.

According to a further characteristic feature of the invention, the heat exchanger in each cooling and recirculating unit consists of a rectilinear water-cooling tubes group preferably vertically passed through the respective suction chamber. Thanks to this feature of the invention, the efficiency of the heat exchanger with equal overall dimensions is considerably improved with respect to the known construction with perforated horizontally arranged individual boxes and with a heat exchanger consisting of a recumbent U-shaped or horse shoe-shaped cooling tube group.

In comparison to the known constructions, the device of the invention furthermore affords the advantages of a simpler construction and a lower cost with reference to the attained performances, as well as the advantages of being very strong and of requiring practically no maintenance, or anyhow very little maintenance. The device of the invention is of a reduced weight, whereby it can be more easily disassembled and reassembled.

These and other characteristic features of the invention and the advantages arising therefrom will clearly appear also in the following specification of one preferred embodiment thereof, diagrammatically shown by way of a non-limiting example in the accompanying drawings, in which:

DESCRIPTION OF THE PREFERRED EMBODIMENT

Figure 1:
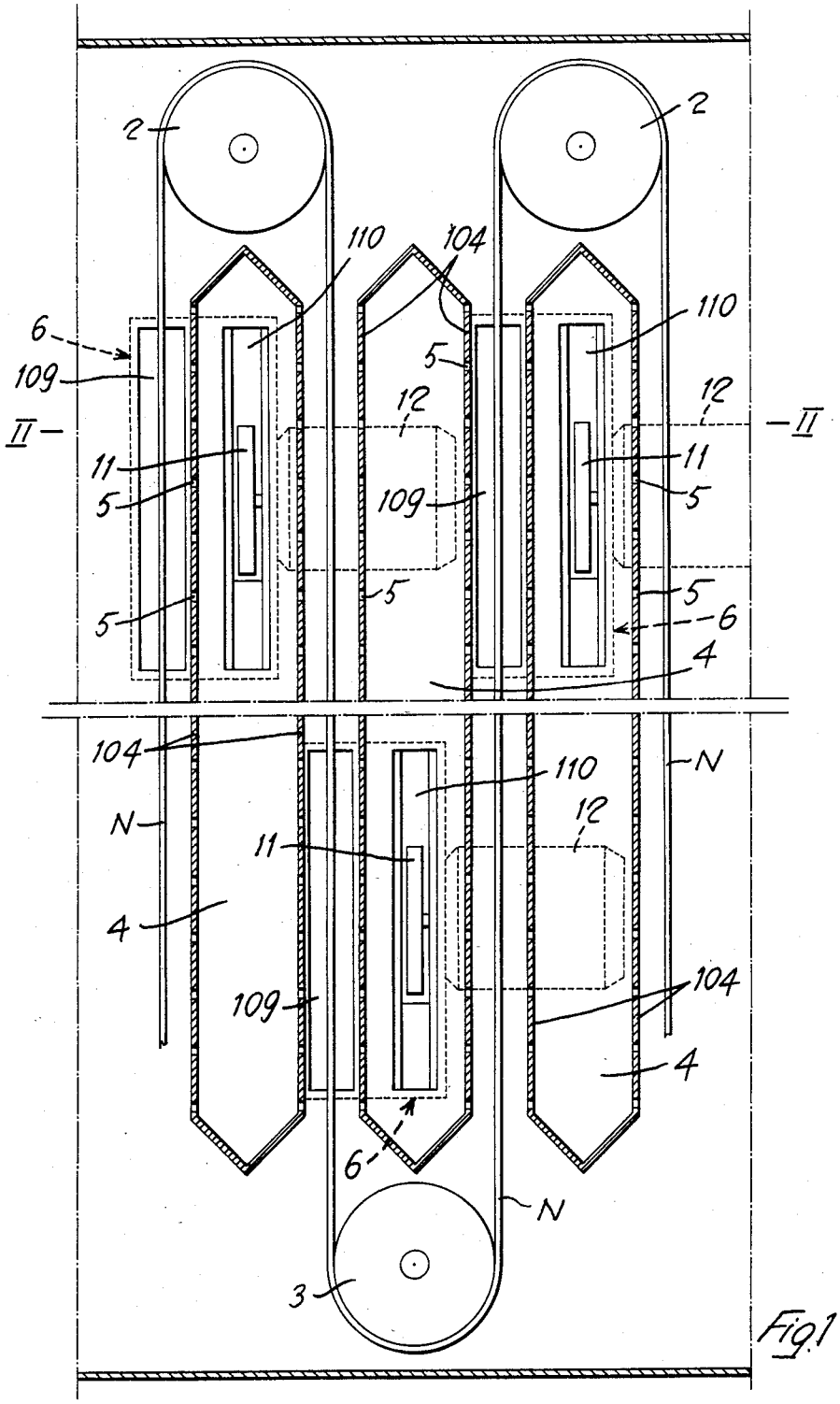
FIG. 1 is a partial vertical section through the final cooling chamber of a furnace for the continuous annealing of steel strips, and the said vertical section is taken along a plane being directed transversely to the horizontal rectangular cross-section of the perforated vertically arranged boxes provided in the furnace interior, that is to say, substantially on line I—I in FIG. 2.
Figure 2:
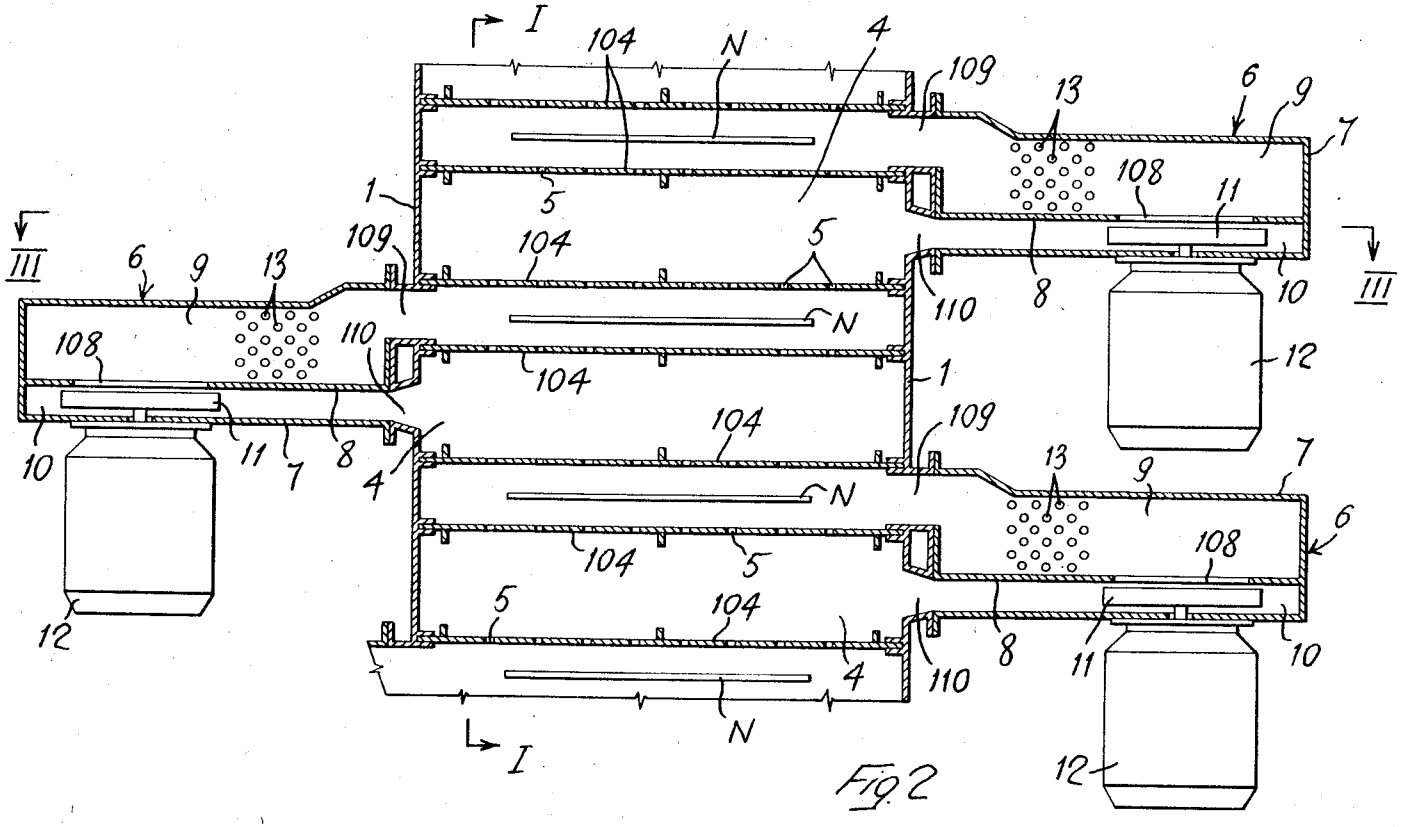
FIG. 2 is a partial horizontal cross-section, for example taken on line II—II in FIGS. 1 and 3.
Figure 3:
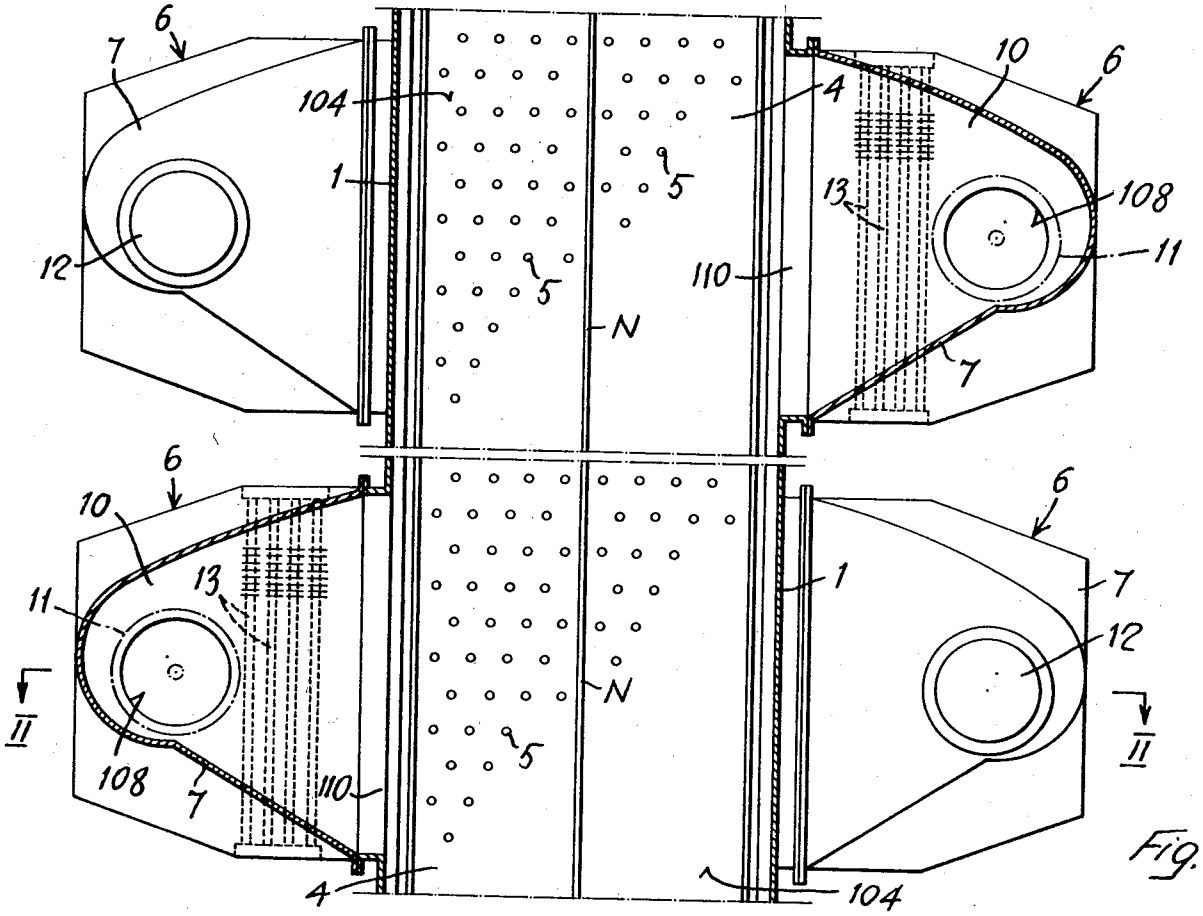
FIG. 3 is a partial vertical section taken along a plane being directed longitudinally of the rectangular horizontal cross-section of the perforated vertically arranged boxes, substantially on line III—III in FIG. 2.

Referring to the Figures, numeral 1 denotes the two opposite sidewalls of the final cooling chamber of a furnace for the continuous annealing of steel strips. The steel strip N is alternately led around upper and lower guide rollers 2, 3, so that it presents spaced apart, vertically extending parallel sections therebetween. In the interior of the furnace vertically arranged boxes 4 are provided between the vertically extending sections of the strip N; these boxes are rectangularly shaped in horizontal cross-section, and extend substantially over the whole length of the said vertically extending strip sections, i.e., practically throughout the height of the furnace. The two opposite longitudinal sidewalls 104 of boxes 4, which are turned toward the strip N, are provided with perforations 5.

A plurality of units 6 for the cooling and recirculation of the gas (such as, for example, HNX) forming the protective atmosphere in the furnace, are provided on the furnace outside, along each vertically arranged box 4. Preferably, the superposed successive cooling and recirculating units 6 which are associated to each vertically arranged box 4, are alternatingly provided on both of the furnace opposite sidewalls, and the vertically extending file of the spaced apart cooling and recirculating units 6, which are associated to one vertically arranged box 4, is vertically offset from the vertically extending row of the cooling and recirculating units 6 which are associated to the adjacent vertically arranged box or boxes 4. Thus the access will be facilitated to every one of the cooling and recirculating units 6, as well as their fitting up and their removal.

Each protective gas-cooling and recirculating unit 6 consists of a sealed case element 7 which is tightly attached, such as by welding, onto the outside of the respective furnace sidewall 1, and which by means of an internal vertical partition 8 substantially perpendicular to the furnace sidewall 1, is comparted into a suction chamber 9 and into a delivery chamber 10 lying therebeside. Through a delivery port 110 in the corresponding sidewall 1 of the furnace, the delivery chamber 10 communicates with the interior of the box 4 that is associated with the appertaining cooling and recirculating unit 6. Through one side of the associated vertically arranged box 4 the suction chamber 9 communicates with the interior of the furnace, through a suction port 109 in the corresponding furnace sidewall 1. Both the suction port 109 and the delivery port 110 are situated on the inner side of the edge by which the case 7 is tightly attached to the furnace sidewall 1.

The suction chamber 9 and the delivery chamber 10 are in communication with each other through a port provided in the partition 8, and forming the suction inlet of a preferably centrifugal fan accomodated in the delivery chamber 10. The delivery outlet of said fan 11 opens into the delivery chamber 10 itself. The fan 11 is driven by an electric motor which is flange-mounted directly onto the case element 7 of the respective cooling and recirculating unit 6. In the suction chamber 9, between the port 109 communicating with the interior of the perforated vertically arranged box 4, and the suction inlet of fan 11, there is provided a heat exchanger consisting of a group of rectilinear finned tubes 13 tightly passed through the suction chamber 9 of the case element 7 in the vertical direction, and in which cooling water flows.

From the foregoing it appears evident that the fan 11 of each cooling and recirculating unit 6 draws the protective gas from the furnace interior through the suction chamber 9 and the suction inlet 108, thus causing the said gas to flow between the water cooling tubes 13 of the heat exchanger provided in the said suction chamber, and so suitably cooling this gas. The fan 11 blows with a certain pressure the thus cooled protective gas through the delivery chamber and the delivery port 110 into the associated vertically arranged box 4. This gas flows out of this vertically arranged box 4 through the perforations 5 in its opposite sidewalls 104, in form of jets directed to the facing surfaces of the two vertically extending sections of strip N, to cool the said strip.

The cooling and recirculating units 6 are of perfectly tight construction, whereby it is reliably excluded any inflow of ambient air which would inevitably pollute the protective atmosphere in the furnace interior, and would result in the surface of the strip N being oxidated, and in the subsequent tinning thereof being impossible.

Of course the invention is not limited to the just described and shown embodiment, but the same may be widely changed and modified, the more so in construction, and may be applied to any kind of furnace for the continuous processing of any metal strips, in which it is required to cool and recicle the gas forming the atmosphere inside the furnace, at least in one strip-cooling section thereof, however without departing from the leading principle as set forth hereinabove, and as claimed hereinafter.

We claim:

1. Apparatus for the cooling and recirculation of gas forming a protective gas in the cooling chamber of furnaces for continuous processing of a metal strip, particularly for the continuous annealing of a steel strip, which comprises a plurality of horizontally arranged boxes (4) each of which extends vertically between successive vertically extending parallel sections of the strip substantially over the whole height thereof, each of said boxes having opposed walls (104) transverse to furnace side walls, each of said opposed walls facing a respective adjacent strip section and being provided with perforations (5), a plurality of protective gas-cooling and recirculating units 6, each of said units comprising a heat exchanger (13) and a fan (11), said fan being adapted to draw from the furnace interior the protective gas, to cool the gas by causing it to flow through the heat exchanger (13), and to blow at a certain pressure the protective gas into the boxes (4), the protective gas flowing out of the perforations (5) provided in the boxes (4) in form of jets being directed to the facing surfaces of said respective adjacent strip sections to cause cooling thereof, each of said plurality of individual cooling and recirculating units being attached to the outside of said furnace sidewalls (1) and distributed over the vertical extent of said boxes such that cooling and recirculating units which are adjacent each other are vertically staggered.

2. Apparatus according to claim 1, characterized in that the cooling and recirculating units (6) which are associated with adjacent vertically arranged boxes (4), are alternatingly provided on opposite sidewalls of the furnace.

3. Apparatus according to claim 1, characterized in that each individual cooling and recirculating unit (6) that is associated with one perforated vertically arranged box (4), consists of a sealed case element (7) which is tightly attached to the outside of the furnace sidewall (1), and is compartmented into a suction chamber (9) containing a heat exchanger (13) and communicating with the furnace interior through the side of the respective vertically arranged perforated box, as well as into a delivery chamber (10) containing a fan (11) and communicating with the interior of the said vertically arranged perforated box, the suction inlet (108) of the fan (11) being connected with the said suction chamber (9), and the delivery outlet of the fan being connected with the said delivery chamber (10).

4. Apparatus according to claim 3, characterized in that the heat exchanger (13) in each cooling and recirculating unit (6) consists of a group of water-cooling rectilinear tubes (13) between which the protective gas drawn from the furnace interior flows.

5. Apparatus according to claim 4, characterized in that the group of water-cooling rectilinear tubes (13) constituting the heat exchanger of each cooling and recirculating unit (6) extends substantially vertically through the suction chamber (9) in the casing (7) of the respective cooling and recirculating unit (6).

6. Apparatus according to claim 1, characterized in that the fan (11) of each cooling and recirculating unit (6) is a centrifugal fan which is operated by an electric motor (12) being flange-mounted onto the outside of the sealed casing of the respective cooling and recirculating unit (6).

* * * * *